United States Patent [19]

Zayas

[11] Patent Number: 4,644,714

[45] Date of Patent: Feb. 24, 1987

[54] EARTHQUAKE PROTECTIVE COLUMN SUPPORT

[75] Inventor: Victor A. Zayas, Alameda, Calif.

[73] Assignee: Earthquake Protection Systems, Inc., Alameda, Calif.

[21] Appl. No.: 803,895

[22] Filed: Dec. 2, 1985

[51] Int. Cl.[4] ..... E04B 1/98

[52] U.S. Cl. ..... 52/167; 248/562; 248/638

[58] Field of Search ..... 52/167, 573; 248/638, 248/562

[56] References Cited

U.S. PATENT DOCUMENTS

| | | | |
|---|---|---|---|
| 1,005,963 | 10/1911 | Groat et al. | 248/638 |
| 1,761,322 | 6/1930 | Wells | 52/167 |
| 2,014,643 | 9/1935 | Bakker | 52/167 |
| 2,680,259 | 6/1954 | Milk | 52/573 |
| 3,347,002 | 10/1967 | Penkuhn | 52/167 |
| 3,606,704 | 9/1971 | Denton | 52/167 |
| 3,789,174 | 1/1974 | Barkan et al. | 52/167 |
| 4,320,549 | 3/1982 | Greb | 52/167 |
| 4,328,648 | 5/1982 | Kalpins | 52/167 |
| 4,330,103 | 5/1982 | Thuries et al. | 248/562 |
| 4,496,130 | 1/1985 | Toyama | 248/638 |

OTHER PUBLICATIONS

D. C. Evans and G. S. Senior, Self-Lubricating Materials for Plain Bearings, Tribology International, Oct. of 1982, pp. 243 thru 248.

*Primary Examiner*—James L. Ridgill, Jr.
*Attorney, Agent, or Firm*—Harris Zimmerman

[57] ABSTRACT

A column support for buildings is presented which protects the building from potentially damaging earthquake ground motions. In each of these column supports the weight of the building is supported by an articulated slider that may slide translationally on an underlying concave spherical surface. The pivot point of the articulated slider is substantially near to the interface of the slider and concave surface. The slider is inherently stable for all dynamic loadings, provides reliable hysteretic friction damping, and can support high loads. A highly effective support is achieved, with small amplitude pendulum motions of the support which function to absorb severe earthquakes.

13 Claims, 5 Drawing Figures

EARTHQUAKE PROTECTIVE COLUMN SUPPORT

TECHNICAL FIELD

This invention relates to supports for buildings or other structures and more particularly to supports for protecting the building or other structure from potentially damaging earthquake ground motions.

BACKGROUND OF THE INVENTION

Contemporary engineering design professionals are generally in agreement that it is primarily the horizontal ground vibration motions of an earthquake that are damaging to a building. The majority of structural details in buildings are designed primarily to support vertical loads, and the factors of safety used for gravitational dead and live loads are generally considered sufficient to account for vertical seismic loads. Furthermore, vertical earthquake motions are typically less intense.

Severe earthquake excitations occur in close proximity of moderate earthquakes, and at further distances from major earthquakes. For example, for moderate earthquakes (of Richter magnitudes ranging from 5.5 to 6.6) at locations less than 5 miles from the causative fault surface, the peak horizontal ground accelerations typically have been measured in the range of 50% to 125% g (where g is the acceleration of gravity). At locations ranging from 5 miles to 25 miles from the moderate earthquake source, the peak accelerations typically measure 10% to 50% g. Acceleration data for locations near major earthquakes is limited; however, major earthquakes affect much larger areas, have significantly longer durations, and can have somewhat larger accelerations.

Building code regulations typically specify the magnitude and distribution of the minimum horizontal earthquake forces for which conventional buildings should be designed on a linearly elastic basis. The design strength of buildings to withstand the imposed dynamic earthquake forces in a linear elastic manner is well understood and is implemented in the design by quantifiable standard structural procedures. The specified minimum horizontal forces of the building codes typically correspond to forces induced by an earthquake with peak ground accelerations on the order of 50% g, which corresponds to a relatively minor earthquake ground excitation. To design for the much larger moderate or severe ground shaking excitations on a linearly elastic strength basis would considerably increase the cost of a structure. Therefore, building regulations permit a design based on the minimum horizontal forces, but only when the structure has sufficient ductility to absorb the motions and energies of anticipated moderate and severe ground shaking intensities without life-threatening collapse.

The conventional approach to designing buildings is to design and detail the entire structure to have sufficient ductility and energy-absorbing capacity to absorb the motions and energies of an earthquake. This conventional ductility approach depends on distributing inelastic deformations throughout the structure, and is complicated by the large variations in arrangements of structural configurations and details. The ductility and energy absorbing capacities of a structure involve complex interactions of the structural components and loadings that are difficult to quantify and explicitly design for. These complex interactions can best be utilized by incorporating a balanced structural design with regular structural configurations, and ductile detailing for components and connections. The building's design strength is reduced below the horizontal forces that would be caused by severe earthquake motions, based on the ductility of the building. The reduction of the design strength in proportion to the earthquake forces is the reduction factor, or R factor. The R factor is difficult to quantify, and can usually only be approximately estimated. Damage to the building and its contents are expected for moderate and severe ground shaking, but collapse of the building is avoided.

The ductility approach is based on satisfactory performance of buildings with regular configurations and ductile detailing during past earthquakes. Most building codes explicity exclude applying the minimum seismic forces to design nonconventional buildings. Because of known failure of some building types during prior earthquakes, most building professionals recommend against constructions with asymmetric designs split levels, major discontinuities in structural elements, multi-story open spaces, soft first stories, tilt-up construction methods, excessively perforated shear walls, excessively glazed exterior walls, or incompatible building components and structural elements. The conventional ductility approach is difficult to appropriately implement and quantify for irregular structures. The use of unquantified R factors is not appropriate. Collapse of the building becomes a risk. The proper design of nonconventional buildings involves an individual determination of the ductilities and energy absorbing capacities for the components and total assemblage.

The horizontal forces due to severe earthquake excitations can be 10 to 20 times larger than the minimum horizontal seismic forces required by building codes. For such large discrepancies it is difficult to quantify the adequacy of the R factors, and R factors larger than 3 should be very carefully verified. Furthermore, during severe excitations considerable damage to the structure and to non-structural building components and contents can be anticipated. These could lead to serious consequences for facilities that may be essential for operations after an earthquake (such as hospitals, fire and police stations, communication facilities, and municipal administration centers). For any building there are significant risks of extensive damage and loss of function for extended periods of time, which may lead to large economic losses.

In the base isolation approach, the structure is supported on devices that are specifically designed to absorb the motions and energies of the earthquake impact. Base isolation is a conceptually simple approach which is gaining recognition as an effective protection against earthquakes. Unfortunately, the previously available base isolation systems have been difficult and expensive to incorporate into conventional building construction. Furthermore, the vibration isolation devices that are used to isolate machines and equipment from general vibrations have not been applicable to buildings because they usually have small load capacities, can accommodate only small amplitude motions, include vibration isolation from vertical motions, and often incorporate complex mechanical, hydraulic, or pneumatic support systems.

Base isolation systems for buildings that do not have a restoring force are not adequate. They have a zero frequency response and are susceptible to excessively large displacement. These systems are vulnerable to unrestrained displacements resulting from ground rotations or tilting caused by ground distortions or settlements. Systems incorporating independent springs for the restoring force tend to be complex because of the encumbrance of having to also provide a distinct means for vertical support while permitting the lateral movement. Active systems that incorporate electronic feedback and servo-controlled systems are certainly too complex, not reliable enough, and require excessive maintenance.

Base isolation systems using rubber pad supports have had some limited but successful applications to buildings. Contemporary rubber pads employ thin layers of rubber and steel to increase the vertical stiffness. These rubber pads accommodate lateral displacements through shearing strains in the rubber layers. The lateral stiffness of the rubber pads decreases both with increased vertical load and with increased lateral displacements, constituting inherent instability characteristics. These instability characteristics limit the lateral displacements that can be accommodated. The lateral stiffness characteristics of the pad support system are such that eccentricities are expected to occur between the center of lateral resistance and the building's center of mass, inducing torsional response motions. The torsional motions can double the required displacements and strains which the isolator pads must absorb, and it can be difficult to accommodate the required strains without exceeding the stability limit of pads with practical proportions. Rubber bearings with sufficient height to accommodate large lateral displacements have reduced stability and vertical stiffnesses. Reduced vertical stiffness can result in a rocking mode which has a period susceptible to amplification, and can also increase the vertical mode period to a more susceptible range. Local rotations of the connection plates of the pads add to the strains and instability of the pad. These rotations and the lateral displacement instability are controlled by incorporating both a rigid structural framework above the pads and perimeter foundation walls, but this has considerably increased the cost of using such systems.

Another category of base isolation systems which has had some limited but successful applications is that of roller or rocker bearings. Many variations for roller and rocker bearing systems have been proposed. In general, the systems that have restoring forces have worked, but have practical limitations, including: the carrying capacity of each roller bearing is limited by the small contact bearing area; they are awkward and expensive to implement; and they require separate additional energy absorbing mechanisms.

A category of base isolation devices which has received little recognition and attention are pendulum systems. Some systems of this kind for buildings consist of cradle frames and slings with releasable mechanisms to restrain against small amplitude motions. The slings act as pendulum arms, providing the lateral motion capability. However, the cradle frames, slings, and releasable mechanism are cumbersome, difficult to implement, of limited load carrying capacity, and of questionable reliability.

Another proposed column support for buildings includes a pedestal suspended by hanger-rods. The system would not work effectively as proposed because the hanger-rod lengths were proportioned considerably too short, and there is no explicit damping. The system is not practical because it does not easily accommodate a correctly-proportioned pendulum length and swing, has low load-carrying capacity, and is expensive to fabricate and cumbersome to implement.

Another support system includes an earthquake protective platform for electrical apparatus, suspended from rigid pendulum links, and with attached viscous dampers. The system had a predictable period of motion that could effectively be used as a base isolation system. The suspended platform approach, however, is not practical for buildings. Furthermore, the required length of the pendulum links is generally 4 ft (1.2 m) or longer, which creates practical difficulties for application to buildings.

The prior known pivoted sliding supports have not been designed in a manner suitable for base isolation. They have pivot points substantially above the sliding surface, have low load capacities, and do not include a means of achieving reliable hysteretic friction damping. One construction of this type includes a three-point foundation system employing combinations of fixed and sliding supports. This unusual foundation system was designed to accommodate vertical undulating deformations of the ground surface and fissures of the ground surface beneath a building. Two embodiments of the sliding mechanisms employ pivoted shoes on concave surfaces that are used to accommodate relative horizontal ground distortions between the supports, and would appear to work satisfactorily for this purpose. In one embodiment, a fixed support is used in conjunction with the sliding shoes, and the fixed support absorbs the lateral forces and provides lateral stability to the shoe supports. In an alternative embodiment, the construction includes rubber-like bushings beneath the sliding support which would absorb high-frequency small-amplitude motions. If the rubber bushings are designed to protect the sliding shoes from the major lateral inertial forces, then the rubber bushing would be serving as the primary base isolation means.

If the pivoted shoes were used under all supports without the fixed support and without adequate rubber bushings, serious difficulties would arise. The shoes would be directly subjected to the large inertial forces and the high velocity and displacement motions of the horizontal earthquake excitation. Because of the height of the pivot point above the sliding surface, the shoe is subjected to an overturning moment which is equal to the product of the lateral force on the building times the height above the surface. This overturning moment tends to topple the shoe, leading to an instability, and at best irregular sliding motions.

The pivoted shoe designs are such that the heights of the pivot points above the sliding surfaces range from 17% to 33% of the radius of curvature of the sliding surface. Furthermore, when the shoe is in a tilted position the height of the pivot point causes the resultant vector of the weight of the building, which is at the pivot point, to shift toward one edge of the shoe. This shifting of the weight reduces the stabilizing moment provided by the weight of the building and also induces the weighted edge of the shoe to gouge into the supporting surface. The gouging increases the frictional resistance and further contributes to toppling the shoe.

The nonuniformity of the normal pressure also leads to a stick slip phenomenon in the sliding motions. Additionally, if subjected to high-velocity non-lubricated sliding, the surfaces could seize to one another due to a cold welding phenomenon. Most important, sliding the surfaces of the shoe and concave surface would tend to adhere to each other after years of high-pressure contact, and therefore would not slide when required.

At a severe intensity of lateral shaking the supported building may also undergo a lateral rocking motion. This rocking motion would cause a temporary uplift of individual shoes. It is noted that the shoe itself, after uplift, is also subject to horizontal acceleration motions which will rotate the shoe relative to the building. Consequently, the shoe rotates out from under the building, leading to improper alignment and an unacceptable instability upon recontact with the sliding surface.

These limitations apply to any pivoted sliding support where the pivot point is a substantial distance above the sliding surface. For non-lubricated systems these limitations are exacerbated when inappropriate materials for the frictional interface are used. For lubricated systems it is difficult to maintain adequate interface lubrication during prolonged periods of non-sliding. The height of the pivot point above the sliding surface also induces horizontal and vertical displacements of the pivot point and supported building relative to the shoe's sliding surface. The building, therefore, does not follow the same horizontal-vertical kinematic relationship as that of the concave surface.

SUMMARY OF THE INVENTION

In one aspect, this invention provides a support for a building or other load, the support having a concave load bearing surface that has a predetermined center of curvature and a predetermined radius of curvature. The support further includes a load bearing component which is spaced from the concave surface, which extends away from the concave surface and which is translatable relative to the concave surface. The support still further includes a load transmitting slider disposed between the load bearing component and the concave surface. The slider being tiltable relative to the load bearing component about a predetermined pivot point. The pivot point is spaced from the center of curvature of the concave surface by a distance which exceeds 90% of the radius of curvature of the concave surface.

In another aspect, the invention provides a support for a building or other load which includes a member having a substantially horizontally extending concave load supporting surface, and a load supporting component spaced from the concave surface and having a spherical concavity facing the concave surface. The support further includes a load transmitting slider having a first convex end surface fitted within the spherical concavity and which has substantially the same radius of curvature as the spherical concavity, and a second convex end surface adjacent to and having substantially the same radius of curvature as the concave load supporting surface. The height of the slider being less than twice the radius of curvature of the first convex end surface.

In still another more specific aspect, the invention provides a support for a building or the like which includes a member having a horizontally extending concave spherical load supporting surface and a load supporting component which is spaced from the concave surface and which has a spherical concavity at the end that is closest to the concave surface, the center of curvature of the concavity being located substantially at the concave surface. The support further includes a load transmitting slider disposed between the load supporting component and the concave surface and which is tiltable relative to the load supporting component. The slider has a spherical portion situated within the concavity of the load supporting component and which has the same radius and center of curvature as the concavity. The slider further has a convex surface that is disposed against the concave surface and which has the same center of curvature and radius of curvature as the concave surface.

In supports embodying the invention, the weight of the load is supported through the slider and concave surface which can translate relative to each other in response to earth movements. The slider pivots during such translation to maintain full contact with the concave surface. The point about which the slider pivots is near or at the interface of the slider and the concave surface. Consequently, the slider is inherently stable for all dynamic loadings, can provide effective hysteretic friction damping, and has high load capacities. The resulting dynamic response of the supported building or other structure is that of a pendulum. The contact pressure at the interface between the slider and dish member remains substantially uniformly distributed during sliding motion enabling effective hysteretic damping and avoiding gouging. The support provides highly effective absorption of earthquake motions and energies with reliable and predictable response and high load carrying capacity. The support is mechanically simple, is easily incorporated into conventional building structure, tolerates foundation setlements and rotations and is effective for aftershocks. In those embodiments in which the pivot point is located at the concave surface, the resulting kinematics are such that the radius of curvature of the concave surface determines the length of the equivalent pendulum arm and its natural period of motion.

BRIEF DESCRIPTION OF DRAWINGS

For a better understanding of the EASP support system, reference may be made to the following drawings and descriptions.

DETAILED DESCRIPTION OF THE PREFERRED EMBODIMENTS

Figure 1:
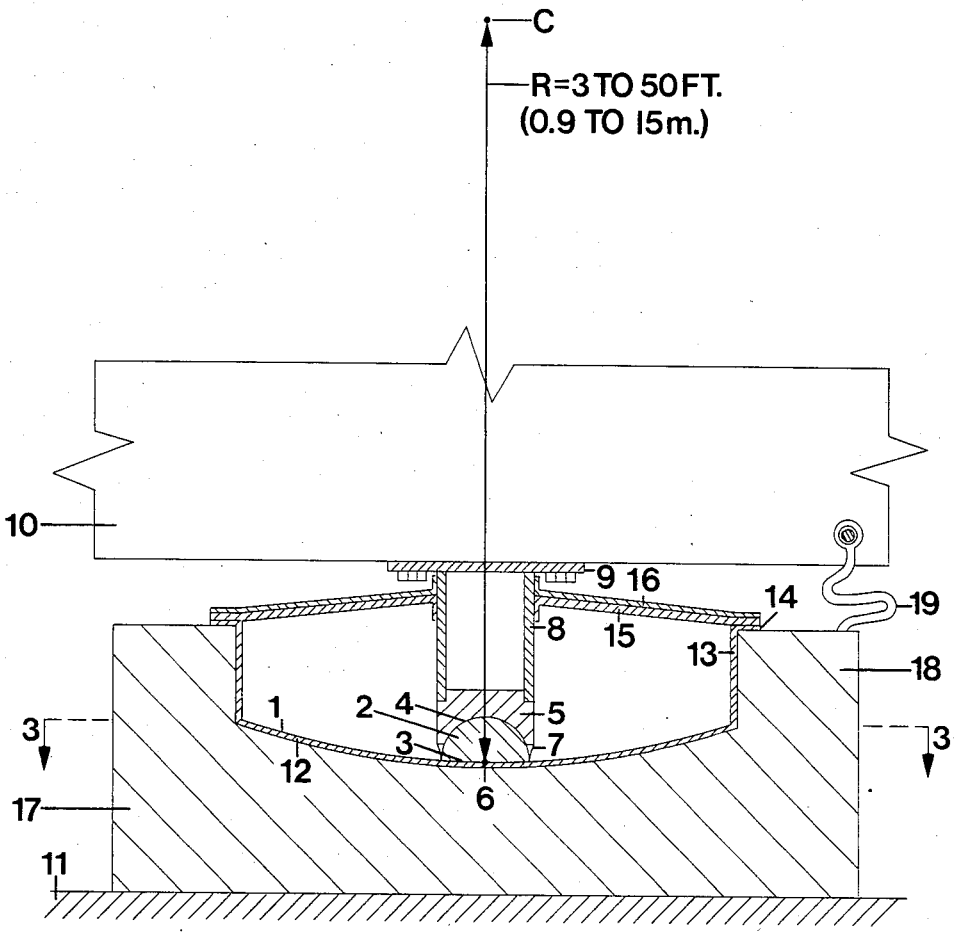
FIG. 1 is a sectional view of the support device taken as a vertical plane so as to illustrate the principal components.

The EASP support is a ductile and energy-absorbing column connection that achieves an effective base isolation. Referring to FIG. 1: The supported structure 10 is supported on the supporting foundation or structure 11 by means of the EASP system. Only a portion of the complete supported structure 10 is shown; other portions of the structure would be supported in a similar manner. The concave sliding surface 1 has a substantially spherical shape with a specified length of radius of curvature designated by letter R in FIG. 1 and which will be hereinafter discussed in more detail, the center of curvature of the surface 1 being designated by letter C in FIG. 1. The articulated slider 2 has a convex sliding surface 3 with a spherical shape and a radius of curvature R substantially equivalent to that of the concave sliding surface 1. The convex sliding surface 3 is designed to slide translationally along the concave sliding surface 1.

The articulated slider 2 comprises the convex sliding surface 3 and all the components that move as an integral unit with the convex sliding surface 3. The articulated slider 2 also has a convex articulating surface 4 which is a sliding surface with a spherical shape. The convex articulating surface 4 permits the slider 2 to rotate about pivot point 6 while the articulated slider 2 slides translationally along the concave sliding surface 1. The pivot point 6 always maintains a constant geometric position relative to the slider housing 5. The pivot point 6, as shown in FIG. 1, is also located at the center of the convex sliding surface 3. The slider housing 5 is a load bearing component which connects the articulated slider 2 and the support column 8. The slider housing 5 has a concave articulating surface which transmits the full vertical and lateral loads of the supported structure 10, from the support column 8, to the convex articulating surface 4 of the articulated slider 2. The support column 8 is rigidly connected to the slider housing 5 and also to the supported structure 10. The support column 8 can be any suitable length and may be an integral part of the supported structure 10. The structure connection plate 9 and its bolts are illustrated as one possible suitable connection of the support column 8 to the supported structure 10.

The supported structure 10, support column 8, and slider housing 5 move as an integral unit with negligible deformations occurring between the slider housing 5 and supported structure 10. The rotating motion of the articulated slider 2 relative to the slider housing 5 permits the convex sliding surface 3 to remain in full contact with the concave sliding surface 1 during translational sliding. Furthermore, the convex sliding surface 3 always remains centered about the pivot point 6, and therefore directly centered under the weight of the supported structure 10.

The concave sliding surface 1 is the inner surface of the dish 12, which is prepared to specified smoothness standards. The dish also has sides 13, and a lip 14. The flexible visco-elastic cover 15 is continuously connected and sealed around the circumference of the lip 14, and around the circumference of the support column 8. The dish 12, together with the sides 13 and lip 14, the flexible visco-elastic cover 15, and support column 8, comprise a sealed unit which protects the concave sliding surface 1 and articulated slider 2 from the environmental elements.

The protective cover 16 provides a rigid protection for the visco-elastic cover 15, and may also be constructed to provide fire protection. The protective cover 16 is connected to the support column 8 in a manner that permits its removal for inspection purposes, and is supported by the lip 14, but is not connected to the lip 14 or the flexible visco-elastic cover 15.

The dish housing 17 provides support for the dish 12, the sides 13, and the lip 14, and a means of connection with the supporting foundation 11. The dish housing 17 can be constructed in a variety of shapes and forms, depending on the application, and is often an integral part of the supporting foundation 11. The lateral displacement stop 18 is a portion of the dish housing which prevents lateral displacements of the support column 8 from exceeding a maximum value. The uplift stop 19 is a steel cable embedded and anchored in the dish housing 17 and connected to the supported structure 10. The inside diameter of the eye of the uplift stop 19 is larger than the outside diameter of the bolt which connects the eye to the supported structure 10. The difference in diameter is positioned to cushion the impact force in the unlikely event the uplift stop 19 becomes necessary.

The main bodies of the articulated slider 2, the slider housing 5, support column 8, and connection plate 9 are economically constructed of structural steel. The dish 12 and protective cover 16 are economically constructed from stainless steel. For special applications other materials of suitable strength can be substituted for steel. The visco-elastic cover 15 is constructed of a viscous elastomer, or synthetic, or natural rubber compound.

Figure 2:
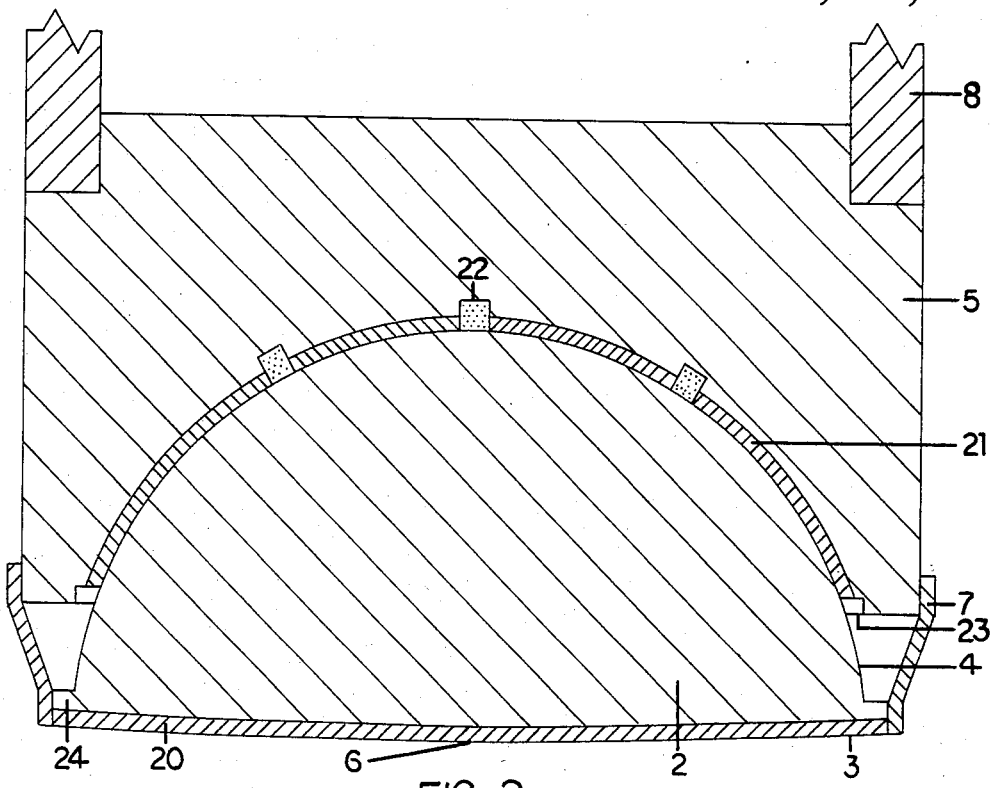
FIG. 2 is a detail view of the articulated slider taken in the same section view as FIG. 1.

FIG. 2 shows details of the articulated slider 2 and slider housing 5. The convex articulating surface 4 is a portion of a complete spherical surface, the area of which is approximately 45% of the area of a complete sphere with equal radius. The convex sliding surface 3 has a convex spherical surface shape and a circular perimeter. The convex sliding surface 3 is the outer surface of a frictional interface layer 20 which is mechanically connected and bonded to the main body of the articulated slider 2.

The important properties of the frictional interface layer 20 are: after several years of in-situ contact without sliding there is no adhesion to the steel concave sliding surface 1; reliable coefficients of friction over a range of velocities from 0 ft/sec to 3 ft/sec (0 m/sec to 0.9 m/sec); and load bearing capacities in the range of 1000 lb/in$^2$ to 30,000 lb/in$^2$ (70.4 kg/cm$^2$ to 2112 kg/cm$^2$). The most useful coefficients of friction generally have values in the range of 0.05 to 0.2, and should not exceed a value of approximately 0.4 after several years of contact without sliding. Several suitable materials are employed which are selected from among the dry bearing composite materials used for unlubricated sliding surfaces in machine, aerospace, and satellite construction. The materials are described in published tribology literature; one such publication, by Evans and Senior, "Self-Lubricating Materials for Plain Bearings," provides a comprehensive review. For different applications a specific material composite is chosen to provide the desired coefficient of friction. Two material composites suitable for varied applications are interwoven polytetrafluoroethane (PTFE) and reinforcing fibers, and PTFE and lead-filled porous bronze.

The bearing interface layer 21 is also constructed of a bearing material and is lubricated once before assembly. The lubrication chambers 22 store sufficient lubricant for lubricating all anticipated articulating motions during the lifetime of the supported structure 10. The lubricants are non-degrading, graphite, or silicon-based. The inner seal 23 retains the lubricant and provides an airtight seal of the inner articulating surfaces. The outer slider seal 7 is mechanically connected and continuously sealed around the circumference of the slider housing 5 and the articulated slider 2. The slider seal 7 is a rugged and elastic membrane that accommodates the articulating motion. The extended lip 24 of the articulated slider provides an attachment surface for the slider seal 7, and functions as a rotation stop for the articulated slider 2.

Figure 3:
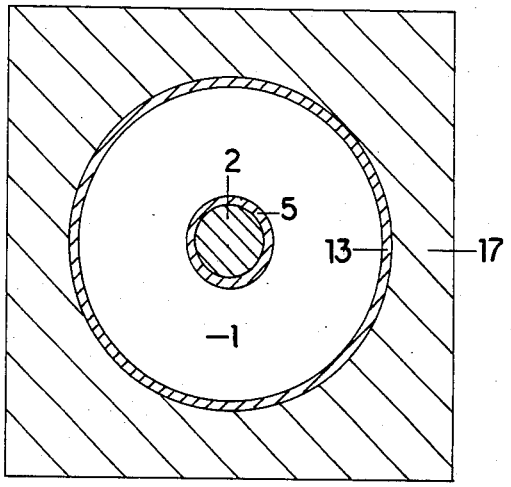
FIG. 3 is a sectional view along line 3—3 of FIG. 1.

FIG. 3 illustrates a sectional view in the horizontal plane of the support device. The dish housing 17 is constructed of poured concrete at the building site, and it is generally easiest to form the outer perimeter with straight sides. The complete sealed unit, including the dish 12, sides 13 and lip 14, articulated slider 2, slider housing 5, visco-elastic cover 15, protective cover 16, support column 8, and connection plate 9, is delivered to the construction site as a single pre-assembled unit, then positioned and secured in the proper location. The concrete for the dish housing 17 is then poured, surrounding and embedding the dish unit. The protective cover 16 is temporarily securely fastened to the dish lip 14 for the delivery, installation, and construction, and then the fastening is removed.

OPERATION OF THE INVENTION

In operation, the EASP support system reduces the maximum magnitude of the horizontal force transmitted to a supported structure, to less than the linear elastic strength of the supported structure. The operation of the EASP support during earthquake ground excitation is best illustrated by referring to FIG. 1. When the lateral force from horizontal ground excitations exceed the threshold force level, the supported structure 10 moves laterally relative to the dish housing 17. The support column 8, slider housing 5, articulated slider 2, and protective cover 16 move laterally together with the supported structure 10. The visco-elastic cover 15 stretches to accommodate the lateral displacement, which is usually only a few inches. The visco-elastic cover 15 stretches to twice its initial length when accommodating the maximum lateral movement. Lateral displacement capacities of any desired magnitude can be accommodated by the system.

The supported structure 10 is supported by the articulated slider 2. The large bearing areas of the articulating surface 4 and the convex sliding surface 3 allow the device to support high structure loads. Of particular importance is that the articulated slider 2 is also inherently stable. For any combination of vertical and lateral forces, the resultant force vector of the structure loads acts normal to the articulating surface 4, and passes through the pivot point 6. Whenever there is any weight on the articulated slider 2, this resultant vector must have a downward orientation and cannot cause an overturning of the articulated slider 2. The friction force that acts tangent to the articulating surface 4 (which is small because the surface is lubricated) also acts as a restoring force to oppose any overturning rotation of the articulated slider 2. Furthermore, since the resultant force acts through the pivot point 6, which is also the center of the convex sliding surface 3, the resulting normal pressure acting on the convex sliding surface 3 has a uniform distribution. This is of particular value to avoid gouging between this layer and the concave sliding surface and also to reduce the stresses and wear on the frictional interface layer 20.

The lateral and vertical displacement relationship of the supported structure 10 is exactly the same as that of the pivot point 6. The pivot point 6 is constrained to slide following the spherical shape of the convex sliding surface 1. The kinematic constraints of the pivot point 6 provided by the concave sliding surface 1 are the same as the kinematic constraints provided by a pendulum arm, with a length equal to the length of the radius of curvature of the concave sliding surface 1. Observe that if the support end of a pendulum arm is at the center of curvature of the spherical concave sliding surface 1, and the weight end is at the pivot point 6, the weight end of the pendulum arm is constrained to move along a spherical surface which is exactly the concave sliding surface 1. Since the weight of the structure in the EASP support has been resolved to act at the pivot point 6, the equivalence of the sliding and pendulum supports is noted. The dynamic motions of a pendulum are a function of this kinematic relationship and the acceleration of gravity g. The friction of the articulated slider 2 is equivalent to the friction of the joints in the pendulum.

The lateral natural period of vibration of the EASP support system is determined from the pendulum equations and is:

$$T=2\pi\sqrt{l/g}$$

where l is the length of the radius of curvature R (the equivalent pendulum length) and g is the acceleration of gravity. This equation is accurate for pendulum motions up to 45 degrees, which is much greater than the angles occurring in the EASP support. It is noted that the period does not depend on the mass or weight of the supported structure. This is particularly valuable in the design of the EASP support system because the lateral period is simply chosen by specifying the length of the radius of curvature. Therefore it follows that any supported weight will have the same period; all portions of a structure tend to cooperate with one another in vibrating at the same period; and the response of the structure is not affected by changes or redistributions of the weight.

Moreover, it is noted that the lateral stiffness of each support is:

$$K=(W/l)$$

where W is the structure's weight. The stiffness is therefore directly proportional to the weight. This is a major advantage for the EASP system because the center of lateral stiffness will always coincide with the centroid of mass, and therefore there is no excitation of torsional motion. Lateral displacements which occur at the corner supports of a building that has mass eccentricities are reduced, often by as much as 50%, as compared with other base isolation systems with springs or rubber pads. Consequently, the EASP system is particularly well suited for asymmetrical structures.

The above dynamic and kinematic properties and stress distributions are satisfied exactly when the pivot point 6 is located at the concave sliding surface 1. Deviations from these properties increase as the pivot point 6 is located away from the concave sliding surface 1, either towards or away from the center of curvature C of the concave sliding surface 1. When the pivot point 6 is located closer to the center of curvature C there is an adverse effect on gouging and slider stability. Locations as much as 10% of the length of radius of curvature (or 50% of the diameter of the convex sliding surface) towards the center of curvature C have serious adverse consequences on the system's response. However, when the location of the pivot point 6 is moved further away from the center of curvature C, during sliding the normal stresses on the trailing edge of the convex sliding surface 3 are greater than the stresses on the leading edge. When this location distance is 1% of the length of the radius of curvature R (or 10% of the diameter of the convex sliding surface 3), the stresses on the trailing edge are 10% greater than those on the leading edge. This can be advantageous as an additional protection against gouging. The effect of this minor relocation on the other stated properties of the system is negligible.

The lengths of the radius of curvature R which provide effective protection from earthquake motions range from 3 to 50 feet (0.9 m to 15 m), depending on the frequency characteristics of the input motion. The shorter radii of curvature are appropriate for earthquake input motion with the predominant natural periods equal to 1 second or less, as is typical of earthquake motions on rock. The longer radii of curvature are appropriate for earthquake input motion with longer natural periods, as occurs for earthquake motions on deep alluvial soil deposits. The selection of the length of radius of curvature is a function of the principles of pendulum motion and the characteristics of earthquakes, and is not dependent on the size or weight of the supported structure. This is distinctly different from the design of conventional structures, machines, or base isolation components in which the size of the support component is selected as a direct function of the size or weight of the supported structure.

Figure 4:
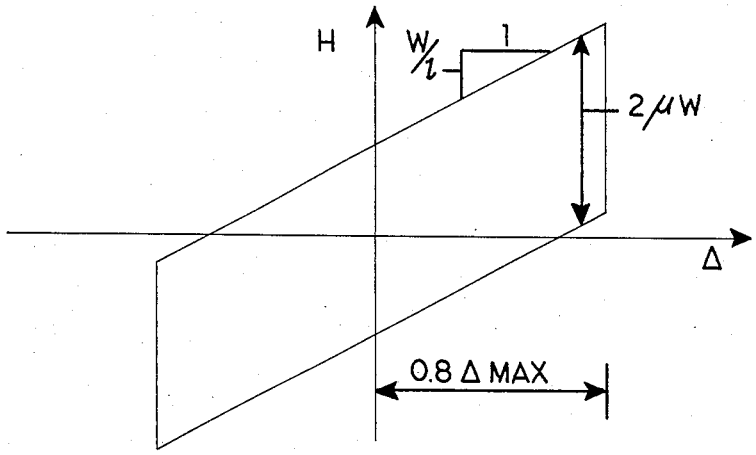
FIG. 4 is an illustration showing the lateral force-displacement hysteretic response of the support device.

These characteristics of the EASP system facilitate analytical models and prediction of the structure's response by means of either hand computations or computer analyses. The hysteretic loop for the lateral force H versus the lateral displacement $\Delta$ is illustrated in FIG. 4. The threshold friction force is equal to $\mu W$, where $\mu$ is the coefficient of friction. The majority of the damping for the EASP system is friction hysteretic damping. The friction hysteretic damping is equal to the area inside the loop. The friction hysteretic damping is displacement-dependent, and has the same effect on dynamic response as does the hysteretic damping of yielding structural components. The frictional properties, however, are easier to predict and more reliable than the yielding capacities of varied structural configurations. The reversal of the direction of the friction force corresponds to the reversal of the inelastic yield force in the yielding structural components. The free vibration response of the system is critically or supercritically damped for typical values of the system parameters.

At force amplitudes below $\mu W$ there is no relative motion across the support for any frequency of input motions. The steady state harmonic reponse of the slider pendulum is such that input excitations with force amplitude above $\mu W$ and with periods less than $T_0/\sqrt{2}$ are absorbed with reductions of transmitted forces and displacements. The maximum forces transmitted are considerably less than the forces transmitted with a rigid base connection, and also considerably less than the forces transmitted by a viscous damped base isolation system with equal energy absorption.

When the input excitations have periods greater than $T_0/\sqrt{2}$ and acceleration amplitudes less than 1.27 $\mu$g, the slider pendulums damp out any transient relative motions and no harmonic motion amplifications occur. When these long period ground accelerations have amplitudes below 1.0 $\mu$g, there is no relative motion across the isolators. Long period earthquake motions characteristically have low acceleration amplitudes. Furthermore, since the EASP system is easily designed to have any natural period, the system parameters $T_0$ and $\mu$ can be chosen to exclude all long period relative motions. Should highly unlikely long period excitations occur which exceed these levels, the input energy in excess of these levels would be absorbed by viscous damping. Viscous damping is provided by the viscoelastic cover 15 and the building components and motions.

The coefficient of friction $\mu$ is of a consistent and reliable magnitude because of the special dry bearing materials used for the frictional interface layer 20. The magnitude of $\mu$ can be checked periodically during the life of the structure by simply attaching a tool to the articulated slider 2 and rotating it about its vertical axis. The energy absorbing capacity of the frictional interface layer 20 is several times larger than the energy absorption required during the most severe of the known major earthquakes.

For earthquake excitations with peak aceleration in the range of 35% to 125% g, numerical investigations using time history computer analysis have indicated that the maximum displacements of the slider 2 in the EASP supports are in the range of 1.5 to 9.5 in. (3.8 to 24 cm), for typical system parameters. The numerical investigations have also indicated that the residual displacement remaining in the supports after applying these earthquake motions are less than 1.5 in (3.8 cm).

The lateral stiffness restoring force, the friction force, and the nonlinear central bias of the friction force collaborate to bring the supports back to the central location after an earthquake. Peak lateral displacements of the supports occur during the periods of most severe ground shaking. The motions of lesser intensity that follow the peak excitations recenter the supports. This recentering effect results because the sum of the stiffness restoring force and friction force are centrally biased; i.e., the force required to increase the relative displacement is always larger than the force required to reduce the relative displacements. Additionally, the friction force itself is larger when resisting an increase of displacements than when resisting a decrease of displacement. The friction force $F_f$ which resists lateral motion is:

$$F_f = \frac{\mu W}{\cos\theta} \pm \mu H \sin\theta \ (0 < \theta < 15°),$$

where H is the lateral force and $\theta$ is the angular displacement of the slider 2. The sign of the $\mu H \sin\theta$ term is positive when H is of a direction to increase the relative displacement, and negative when H is such as to decrease the relative displacement.

The EASP supports result in a large reduction of the lateral earthquake forces on the building compared with a fixed supported structure. This reduction directly reduces the overturning moment on the building and also any tendency for a rocking motion response. The rocking motion primarily depends on the lateral force mangitudes and height-to-width aspect ratio. Since the vertical stiffness of the EASP supports is very high, there is no rocking motion unless the lateral forces become large enough to cause uplift of the columns. However, the EASP support systems are designed such that the lateral forces never become high enough to cause rocking. For example, the lateral force must exceed 0.5 W to cause rocking of a rectangular building with a height-to-width aspect ratio of 2. Correspondingly, the lateral force must exceed 0.25 W to cause rocking of a building with an aspect ratio of 4. The lateral forces for an EASP-supported building can be constrained below these magnitudes for very severe earthquakes and therefore a high probability of no rocking motion can be obtained. The probability of rocking motion occurring increases as the aspect ratio increases. An aspect ratio of 4 is recommended as a practical upper limit for the EASP support as configured in FIG. 1. For higher aspect ratios, additional restraints to control rocking motions can be added.

Rocking motions can be beneficial in reducing the lateral forces on a building, and some earthquake support systems are designed specifically to allow and control uplift. The EASP support system is designed primarily to avoid rocking motions. However, the system is designed to perform adequately and control rocking motions should they occur. In the unlikely event that they do occur, the uplift stop 19 prevents excessive rotations of the building. The cable is of a length which allows the full lateral displacement of the support column 8, but prevents uplift of the support column 8 over the lateral displacement stop 18. As many uplift stops as desired can be connected. Separation of the articulated slider 2 and slider housing 5 during any unlikely uplift of the support column 8 is prevented by the mechanical strength of the slider seal 7. The airtight nature of the inner seal 23 and slider seal 7 also maintains a suction force which prevents the separation of the articulated slider 2 and slider housing 5. In the event of uplift of the support column 8, the suction maintained by the inner seal 23 supports the weight of the articulated slider 2 backed with the redundancy of the airtight construction of the slider seal 7, and the redundancy of the mechanical strength of the slider seal 7. The uplift capacity of the suction equals twenty-four times the weight of the articulated slider 2 and the mechanical capacity of the slider seal 7 is equal to forty times the weight.

The vertical ground accelerations of the most severe recorded earthquake motions are not sufficiently large to cause uplift of the entire structure. The vertical ground excitations in combination with rocking uplift forces can contribute to potential uplift of individual columns; however, the vertical excitations are typically of such high frequency and small displacement magnitude that the uplift is not significant.

As a redundancy in the unlikely event of failure of the entire support column 8, the displacement extension stop 18 can also serve as a direct support for the supported structure 10, and the clearance shown between them can be kept to a minimum if desired. In the unlikely event of failure of the articulated slider 2, the slider housing 5 provides support for the support column 8.

The initial implementation of the EASP supports is for an asymmetrical building on a rock hillside site. The building site is located in the Crocker Highland Hills, Oakland, Calif., 0.75 miles (1.2 km) from the Hayward fault and 17 miles (27.4 km) from the San Andreas fault. Design considerations for the hillside site resulted in a stepped multiple split-level building, with an unavoidably asymmetric irregular structure. For this irregular structure without EASP supports, it is difficult to accomplish a uniform distribution of the inelastic strains using the conventional ductility approach. Concentrations of deformation in critical components are expected during inelastic deformations. Furthermore, torsional response motions are unavoidable and would also lead to concentrations of deformations in critical components.

The building has a height-to-width aspect ratio of 1.67, a designed elastic lateral strength of 0.186 W, and a calculated natural period of 0.35 seconds. The El Centro input motion, scaled to a peak acceleration of 7% g, resulted in the design lateral forces. This was taken as the linear elastic design earthquake, and assigned a nominal intensity factor of 1. The unscaled El Centro motion has a peak acceleration of 35% g and a relative intensity factor of 5. The El Centro input motion, scaled by a factor of 2, was used as the inelastic design earthquake, and has a corresponding intensity factor of 10.

Figure 5:
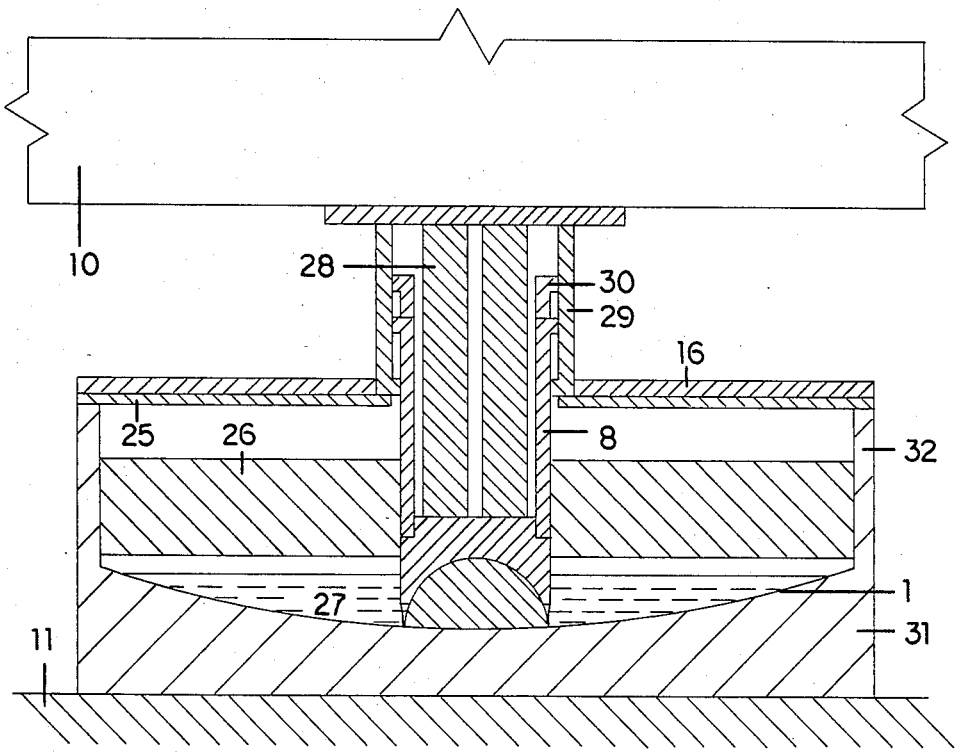
FIG. 5 is a sectional view of another embodiment of the support device, taken in a similar vertical plane as FIG. 1.

The design of the EASP supports employed the components as illustrated in FIG. 1, with the proportions of the lateral stiffness, threshold friction force, and lateral displacements as illustrated in FIG. 5. Extensive time history dynamic analyses were performed using three-dimensional earthquake input to verify the performance of the EASP supports, and laboratory testing will precede construction. The El Centro, Pacoima Dam, Park Field, and Kern Taft accelograms were used as input earthquake motions, including all three direction components. These earthquake input histories were also scaled to obtain additional input motion records with different peak acceleration levels.

Fully nonlinear models of the base isolators were used, including material and large displacement nonlinearities. Simplified bilinear models, and also elastic models, of the building were used. The effective yield point in the bilinear model at which significant loss of stiffness would occur was estimated to be 0.28 W, and the post yield stiffness was estimated to be 0.15 times the initial stiffness.

Parametric studies for the design were performed varying natural period and theshold force of the base isolation system. Various intensity levels of all four earthquake input motions were used. A natural period $T_0$ of 2.21 s and a friction coefficient $\mu$ of 0.17 were selected based on minimizing lateral forces in the building, lateral displacements in the supports, and restraining support motions during wind force and elastic level earthquake excitations. Highly effective damage protection was observed for a friction coefficient range of 0.05 to 0.20, with the optimum in the range of 0.10 to 0.17.

The response to earthquake input motions of the bilinear model of the building on EASP supports was compared to that of the same model of the building on conventionally fixed supports. The simplified bilinear model did not include torsion effects, which were negligible for the EASP supported building. Torsion effects would increase the concentration of damage in the fixed supported building, which would limit the building's ductility and energy-absorbing capacity.

The total inelastic energy absorbed by the building was used as a measure of the overall damage that would occur. Absorbed energy magnitudes less than the elastic energy capacity indicated no damage to the building. The ductility demand (lateral displacement/elastic displacement limit) was used as a measure of the overall lateral displacements and deformations required of the building. The ductility demand of individual components were not predicted by the simplified bilinear model.

When subjected to the unscaled El Centro input motion, the maximum displacement occurring within the EASP supports was 1.7 in. (4.3 cm), and the maximum energy absorbed by the building was 0.9 times its elastic energy capacity. Correspondingly, the building on fixed supports absorbed 28 times its elastic energy capacity, with a ductility demand of 3.

Subjected to the inelastic design level earthquake (El Centro scaled by 2) with peak horizontal and vertical accelerations of 70% g and 42% g, respectively, the maximum EASP relative displacement was 3.7 in. (9.4 cm), and the building absorbed 1.2 times its elastic energy capacity. Correspondingly, the building on fixed supports absorbed 210 times its elastic energy capacity with a ductility demand of 19, which were considered to be beyond its expected capacities. Maximum displacements occurring within the building on fixed supports were equivalent to the maximum displacements absorbed by the EASP supports. No uplift of any of the EASP supports occurred.

The most severe response was for the unscaled Pacoima Dam record with peak horizontal and vertical accelerations of 125% g and 72% g, respectively. Maximum displacement in the EASP supports was 9.4 in. (23.9 cm), and the building absorbed 22 times its elastic energy capacity. Short duration uplifts of individual columns occurred. Correspondingly, the building on fixed supports absorbed 306 times its elastic energy capacity, with a ductility demand of 35.

The internal displacement capacity limit of the EASP supports was conservatively set at 12 in. (30 cm) based on the maximum displacement of 9.4 in. (24 cm) as observed for the Pacoima Dam record. For all the earthquake input motions, the residual displacement remaining in the support at the end of the earthquake motions was less than 1.5 in. (3.8 cm).

An elastic model of the building with fully nonlinear EASP supports was used to investigate torsion motion. Torsion motion responses were negligible for the naturally occurring mass eccentricities of the building. The mass eccentricity was increased to check for maximum torsional response. With an imposed mass eccentricity of 25% of the building length, when subjected to the inelastic design earthquakes the maximum torsional motion was 0.06 degrees. Alternatively, the model was subjected to imposed differences in friction coefficients. With the coefficients of friction in the EASP supports varied from 0.1 at one end of the building to 0.2 at the other, the maximum torsional motion was 0.11 degrees. Thus, torsional motions due to these large perturbations were remarkably small.

To accommodate a variety of applications the EASP support system is designed to easily incorporate additional components and features. The support system shown in FIG. 1 can also be installed inverted with the concave sliding surface 1 facing downward, and the supporting structure 11 and supported structure 10 in reverse roles.

Several additional and alternative components are shown in FIG. 5. These may be used individually or in combination with the components shown in FIGS. 1 to 3. The elastic membrane cover 25 shown in FIG. 5 is a flexible membrane providing a sealed cover to the concave sliding surface 1 and is used when viscous damping in the cover is not desired. The visco-elastic solid layer 26 is used to increase the amount of viscous damping. The visco-elastic solid layer 26 is manufactured in the shape of an annulus from an elastomer or from a synthetic or natural rubber compound with a highly velocity-dependent material response. The annulus compresses and stretches during translational sliding. It may be included as a separate component or it may be an integral part of the visco-elastic cover 15 shown in FIG. 1. It may be bonded to or simply fitted in between the dish sides 13 and support column 8. Referring again to FIG. 5, the lubricant 27, for the concave sliding surface 1, is used when low coefficients of friction are desired. Silicon pastes provide an effective non-degrading lubricant for this purpose. A low coefficient of friction is used when vibration isolation is desired from low amplitude horizontal motions. When such low coefficients of friction are used, the visco-elastic annulus 26 becomes advantageous. To additionally control sliding properties, any of the sliding surfaces may be coated with a material that facilitates sliding, fitted with lubrication reservoirs, or fitted with grooves, indentations, or shape variations.

A flexible vertical connection of the support column is used to protect sensitive equipment or buildings from vertical ground excitations. Vertical flexibility is provided by a flexible core 28. The flexible core 28 is an annulus constructed of reinforced visco-elastic layers. The visco-elastic layers have material properties that permit the core 28 to serve as both a spring and damper. The hole at the center of the flexible core 28 permits the visco-elastic layers to expand laterally when compressed. The clearance between the flexible core 28 and the support column 8 is constructed small enough such that lateral support to the flexible core 28 is provided by the support column 8. The support column 8 is constructed of a steel tube with an outer diameter less than the inside diameter of the outer sliding tube 29. The bushings 30 facilitate sliding and prevent overextension of the assembled flexible column.

The base plate 31 is constructed of steel and incorporates the concave sliding surface 1 as one of its surfaces. The steel cylindrical extension 32 facilitates enclosing and sealing the inner components.

Numerous other variations are also possible. For example: the spring core 28 can also be constructed of other visco-elastic materials, or using a helical steel spring and piston viscous damper. Piston viscous dampers may also be used to dampen the lateral displacements. Slotted channels may be used as uplift stops as an alternative to the cable-type uplift stop.

The versatility of the EASP support system facilitates its use in a large variety of applications. The supported structure 10 can be a portion of any structure which is supported, including buildings, power stations, offshore platforms, machinery, equipment, computers, etc. The supporting structure 11 can be a portion of any structure which provides support, including foundations, ground, buildings, structural framework, floors, etc. For example, in an offshore structure the EASP support can be used between the deck and the tower structure. The base plate 31 as shown in FIG. 5 can be used as the connection support pad of the deck with the concave sliding surface 1 in the downwardfacing orientation. The height of the cylindrical extension 32 can be minimized. Other components can be as shown in FIG. 1. The slider housing 5 and articulated slider 2 can be directly fitted to the tower leg such that the tower leg serves as the support column 8, or a short support columns 8 can be used as an extension of the leg.

While the description provided herein contains many specificities, these should not be construed as limitations on the scope of the invention, but rather as exemplifications of the preferred embodiments. It will be obvious to those skilled in the art that various changes and modifications may be made without departing from the invention in its broader aspects. The appended claims are intended to cover all such changes and modifications as fall within the true spirit and scope of the invention. Accordingly, the scope of the invention should be determined by the appended claims.

What is claimed is:

1. In a support for a building or other load, said support having a member with a concave load bearing surface that has a predetermined center of curvature and a predetermined radius of curvature, a load bearing component which is spaced from said concave surface and which extends away therefrom and which is translatable relative thereto, and a load transmitting slider disposed between said load bearing component and said concave surface, said slider being tiltable relative to said load bearing component about a predetermined pivot point, wherein the improvement comprises:

said pivot point being spaced from said predetermined center of curvature of said concave surface by a distance which exceeds 90% of said radius of curvature of said concave surface.

2. The apparatus of claim 1 wherein said pivot point is located substantially at said concave surface of said member.

3. The apparatus of claim 1 wherein said slider has a spherical portion abutting said load bearing component and said load bearing component has a spherical concavity in which said spherical portion of said slider is received, the spherical portion of said slider and said spherical concavity having a single center of curvature located substantially at said concave surface of said member.

4. The apparatus of claim 1 wherein said predetermined radius of curvature of said concave surface of said member has a length in the range from about 3 feet (0.9 m) to about 50 feet (15 m).

5. The appratus of claim 1 further including a volume of compressible visco-elastic material positioned to resist translation of said slider and load bearing component away from a centered location relative to said concave surface of said member.

6. The apparatus of claim 1 wherein said slider has a load bearing convex surface abutted against said concave surface of said member and which has a radius of curvature similar to said predetermined radius of curvature of said concave surface of said member, said slider having a load bearing spherical opposite surface that abuts said load bearing component, said spherical opposite surface of said slider having a center of curvature that is at least substantially coincident with said pivot point.

7. The apparatus of claim 6 wherein said load bearing component has a spherical surface abutting said spherical opposite surface of said slider and which also has a center of curvature that is substantially coincident with said pivot point.

8. The apparatus of claim 1 wherein said slider has a load bearing convex surface abutted against said concave surface of said member and which has a radius of curvature similar to said predetermined radius of curvature of said concave surface, further including dampling means for providing a predetermined degree of friction hysteretic damping of equivalent pendulum motions of said building or other load.

9. The apparatus of claim 8 wherein said damping means includes a layer of dry bearing material of predetermined coefficient of friction disposed at the interface between said concave surface of said member and said load bearing convex surface of said slider.

10. The apparatus of claim 1 wherein said load bearing component includes a volume of visco-elastic material positioned to transmit the weight of said building or other load to said slider and positioned to be compressed by said weight.

11. The apparatus of claim 10 wherein said load bearing component further includes first and second vertically extending tubes disposed in telescoping relationship, said volume of visco-elastic material being disposed within said tubes.

12. In a support for a building or other load, the combination comprising:

a member having a substantially horizontally extending concave load supporting surface, a load supporting component spaced from said concave surface and having a spherical concavity facing said concave surface, and a load transmitting slider disposed between said load supporting component and said concave surface and being tiltable relative to said load supporting component, said slider having a first convex end surface fitted within said concavity and which has substantially the same radius of curvature as said concavity, said slider having a second convex end surface adjacent said concave load supporting surface and which has substantially the same radius of curvature as said concave load supporting surface which radius of curvature is greater than that of said concavity and first convex end surface, the height of said slider being less than twice said radius of curvature of said first convex end surface thereof.

13. A support for a building or the like comprising:

a member having a generally horizontally extending concave spherical load supporting surface, a load supporting component spaced from said concave surface and extending away therefrom and having a spherical concavity at the end which is closest to said concave surface, the center of curvature of said concavity being located substantially at said concave surface, a load transmitting slider disposed between said load supporting component and said concave surface and being tiltable relative to said load supporting component, said slider having a spherical portion situated within said concavity of said load supporting component, said spherical portion having the same radius and center of curvature as said concavity, said slider also having a convex surface that is disposed against said concave surface and which has substantially the same radius of curvature as said concave surface.

* * * * *